US005163968A

United States Patent [19]

Lafferty

[11] Patent Number: 5,163,968

[45] Date of Patent: Nov. 17, 1992

[54] HEADBOARD MOUNTING HARDWARE

[75] Inventor: G. Scott Lafferty, Wausau, Wis.

[73] Assignee: Joerns Healthcare, Inc., Stevens Point, Wis.

[21] Appl. No.: 809,726

[22] Filed: Dec. 17, 1991

[51] Int. Cl.[5] ..... A47C 19/02

[52] U.S. Cl. ..... 5/200.1; 5/8; 5/53.1; 5/288

[58] Field of Search ..... 5/8, 53.1, 132, 200.1, 5/201, 280, 282.1, 285, 288, 293

[56] References Cited

U.S. PATENT DOCUMENTS

| | | | |
|---|---|---|---|
| 2,523,987 | 9/1950 | Fox . | |
| 2,579,206 | 12/1951 | Sands et al. . | |
| 2,697,233 | 12/1954 | Christenson . | |
| 2,712,137 | 5/1955 | Hunter | 5/201 X |
| 3,003,160 | 10/1961 | Goodman . | |
| 3,008,176 | 11/1961 | Paine et al. . | |
| 3,009,170 | 11/1961 | Akram . | |
| 3,061,870 | 11/1962 | Giannini, Sr. . | |
| 3,230,554 | 1/1966 | Peterson . | |
| 3,233,255 | 2/1966 | Propst . | |
| 3,249,953 | 5/1966 | Leskin et al. | 5/285 |
| 3,329,975 | 7/1967 | Hooker . | |
| 3,353,193 | 11/1067 | Greiner . | |
| 3,681,792 | 8/1972 | Korber . | |
| 3,733,623 | 5/1973 | Croxton . | |
| 3,758,895 | 9/1973 | Gunter | 5/288 X |
| 3,877,088 | 4/1975 | Bouman . | |
| 3,916,461 | 11/1975 | Kerstholt . | |
| 4,467,486 | 8/1984 | Schatz | 5/53.1 X |
| 4,501,033 | 2/1985 | Kessel et al. . | |
| 4,536,904 | 8/1985 | Whitehead . | |
| 4,646,371 | 3/1987 | Nowell | 5/201 X |
| 4,774,732 | 10/1988 | Riedl . | |
| 4,936,554 | 6/1990 | Heyward . | |
| 4,970,737 | 11/1990 | Sagel . | |

FOREIGN PATENT DOCUMENTS

| | | | |
|---|---|---|---|
| 2187380 | 9/1987 | United Kingdom | 5/282.1 |

*Primary Examiner*—Michael F. Trettel
*Attorney, Agent, or Firm*—Price, Heneveld, Cooper, DeWitt & Litton

[57] ABSTRACT

Hardware for securing a headboard or footboard to a bed frame includes a socket adapted to be secured to the bed frame, a configured member adjustably disposed within the socket and supporting a mounting plate. The configured member includes an offset end to which the mounting plate is secured. The configured member is provided in mirror image versions permitting a headboard to be positioned at various heights above or at the floor. Axial adjustment of the configured member in the socket adapts the hardware to an adjustable, mechanical bed having multiple pivotally interconnected sections. A swing-apart dual king bracket assembly includes a first, generally U-shaped hinge plate having a base attachable to the mounting bracket of the headboard assembly. A second hinge plate is connected to the first hinge plate by a pivot pin. The second hinge plate may be secured to a headboard or to another bracket assembly mounted on an adjacent bed frame. The dual king bracket assembly and the headboard mounting assembly permit a pair of beds to be pivotally interconnected or pivotally joined to a common headboard. A latch is securable to the bed frames to hold them together in normal use.

16 Claims, 5 Drawing Sheets

HEADBOARD MOUNTING HARDWARE

BACKGROUND OF THE INVENTION

The present invention relates to beds and, more particularly, to headboard and dual king bracket assemblies for an adjustable bed.

Conventional residential beds include a frame, a box spring and a mattress. The mattress lays flat on the box spring. The bed is not adjustable to different angled or elevational positions. The frame may include a fixed bracket for mounting a headboard and/or footboard. Only limited adjustment to accommodate of different headboard sizes is provided. The retail bedding industry has developed mounting dimension standards for conventional twin, double and king size beds. Compliance with the standards is voluntary, however, and standardized mounting dimensions may be eliminated for esthetic or structural reasons. The voluntary standards still provide up to six different vertical mounting hole location options. Problems may be encountered using headboards or footboards from manufactures different than those for the frame.

In addition, it is known to attach a pair of twin size beds to a single headboard to form a dual king arrangement. Swing kits attach the frames to the headboard so that they may be swung apart for ease of linen changes and the like. Available kits do not readily adjust to different mattress widths or variances in headboard dimensions and mounting hole locations.

The problems with accommodating different headboards, footboards and swing kit arrangements are further aggravated with adjustable beds. Adjustable beds are common in the healthcare industry. The beds include a base frame and a multi-section mattress frame. The pivotally connected sections may be angularly adjusted so that the occupant may be moved from a horizontal position to a seated position. The sections are generally adjusted manually or electric motors may be used. Generally, healthcare beds are provided only in a nonstandard or reduced width twin bed size. A twin bed size is approximately four inches less than the standard residential or conventional bed to facilitate movement through doors and the like.

In the healthcare industry, headboards and footboards are typically custom designed to fit the particular unit. The articulating nature or angular adjustment feature of the bed requires that relative motion between the frame and the headboard and footboard be accommodated. Positioning the headboard and footboard too close to the moving frame may create pinch points. Conventional headboards, footboards and the like are not readily usable with known adjustable beds.

Commonly owned U.S. patent application Ser. No. 07/809,879 filed Dec. 17, 1991 and entitled ADJUSTABLE BED WITH WIRE GRID MATTRESS SUPPORT to the present inventor and still pending, discloses an adjustable mechanical bed including a wire grid mattress support which accommodates conventional retail twin, full and queen size mattresses. In developing an adjustable bed for the retail market, the aforementioned problems of headboard/footboard mounting must also be resolved. A system is needed which will mount conventional headboards and footboards to an adjustable bed and which accommodates the articulation of the bed structure. Also, it would be desirable to provide a headboard mounting bracket system which permits twin beds to be pivotally interconnected or pivoted to a headboard so that a king size bed arrangement can be obtained.

SUMMARY OF THE INVENTION

In accordance with the present invention, the aforementioned needs are met and the noted problems substantially eliminated. Essentially, a headboard or footboard mounting assembly is provided which includes a socket adapted to be secured to a bed frame. A configured member has an elongated first portion disposed within the socket for axial and angular adjustment relative thereto. A mounting plate is supported on a free end of the configured member. The plate defines a plurality of vertically spaced slots. The configured member includes offset portions adapting the assembly to mounting a board at or above floor level. Angular adjustment accommodates different mounting hole locations which may be found in conventional headboards and footboards.

In other aspects of the invention, a swing kit is provided which includes a first swing bracket. The swing bracket has a base which defines two different transversely spaced and vertically arranged columns of holes. The swing bracket is attachable to the mounting plate. The alternate mounting holes accommodate the swing kit to different width mattresses and headboards. A second swing bracket is pivotally or hingedly connected to the first swing bracket by a pivot pin. The second swing bracket is attachable to a headboard so that a pair of bed frames may be pivoted to the headboard. In the alternative, the second bracket may be secured to a mounting plate positioned on the end of a configured member on an adjacent bed frame. As a result, a consumer or user can assemble a dual king with headboard and footboard, with headboard only or with no headboard at all. The swing kit permits the twin beds to be swung apart for easy linen changes. In addition, provision is made for latching the beds together for normal use. The assemblies in accordance with the present invention will accept generally available headboards or footboards. Nonstandard mounting dimensions are accommodated. The headboard or footboard may be mounted on the floor or mounted to float or be positioned above the floor for easier bed movement. The articulating nature of an adjustable bed frame is readily accommodated. The mounting plate may be moved inwardly or outwardly in an axial direction to permit the user to adjust the unit to provide the necessary clearance and avoid pinch points. Actual mattress width, which varies from model and manufacture, can be accommodated. The assemblies permit the user to optimize the fit between the adjustable bed frames and the mattresses.

DETAILED DESCRIPTION OF THE PREFERRED EMBODIMENT

Figure 1:
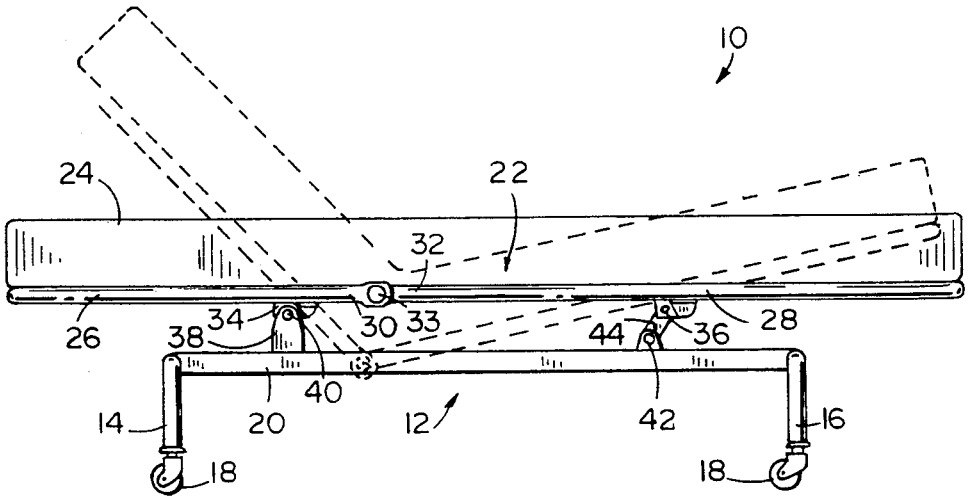
FIG. 1 is a side, elevational view of an adjustable bed with an articulated or adjusted position shown in phantom.

An adjustable bed is illustrated in FIG. 1 and generally designated by the numeral 10. Adjustable bed 10 includes a base frame 12 having legs 14, 16 supported on castors 18. Base frame 12 includes lateral portions 20. A multi-section mattress frame 22 is mounted on base frame 12. Mattress frame 22 supports a mattress 24. In the embodiment illustrated, mattress frame 22 includes a head section 26 and a lower section 28. Sections 26, 28 are tubular members pivotally interconnected at ends 30, 32 by pivots 33. Mattress frame 26 includes tabs 34. Mattress frame 28 includes tabs 36. Tabs 34 are connected to rigid links 38 joined to side portions 20 by pivot 40. Tabs 36 are connected to rigid tabs 42 on side portions 20 by links 44. Mattress frame 22 and, hence, mattress 24 are moveable from a flat, horizontal position illustrated in solid lines in FIG. 1 to an angled, seated position illustrated in phantom in FIG. 1. The adjustable bed includes positioners (not shown), which lock the section in various positions.

Lower section 28 may be formed with an intermediate or seat section pivoted to a foot section. The mattress frame would, therefore, have three sections, which permits adjustment of the bed into a "knee break" position. Such a multi-section construction is illustrated, for example, in commonly owned U.S. patent application to Peterson, Ser. No. 07/540,282, filed Jun. 18, 1990, entitled ADJUSTABLE BED and now U.S. Pat. No. 5,105,486.

The aforementioned related U.S. patent application to the present inventor entitled ADJUSTABLE BED WITH WIRE GRID AND MATTRESS SUPPORT, Ser. No. 07/809,879, filed Dec. 17, 1991 and still pending discloses a mattress support which adapts a multi-section adjustable bed to standard twin, full and queen size widths. The bed construction brings benefits of an adjustable bed to the consumer or retail market.

In accordance with the present invention, headboard-/footboard mounting assemblies generally designated 60, 62 are provided. Assembly 60 includes a tubular socket or bracket mount 64. Mount 64 is welded or otherwise suitably secured to side portion 20 of bed frame 12. Socket 64 adjustably supports a configured or formed tubular member 66. A headboard mounting bracket or support plate 68 is joined to a free end 70 of tubular member 66. Support plate 68 includes a plurality of vertically spaced, transversely extending slots 72, 74. The slots are preferably spaced in multiples of 2½ inches and 4 inches which are current retail bedding industry standards. Mounting assembly 62 includes a tubular socket 64 and a mounting plate or bracket 68. Bracket 68 is joined to a formed or configured tubular member 78. Member 78 is identical to member 66 except that it is a mirror image thereof.

Configured or formed support members 66 and 78 are generally L-shaped in plan view. Each member 66, 78 includes an elongated first leg or portion 92 and a second leg or portion 94 to which mounting plate 68 is affixed. Portion 94 includes a first horizontal section 96; an angled, intermediate portion or section 98 and an outer, horizontal section or portion 100. Portion 100 has a longitudinal centerline which is offset from and parallel to a longitudinal centerline of portion 96.

Figure 2:
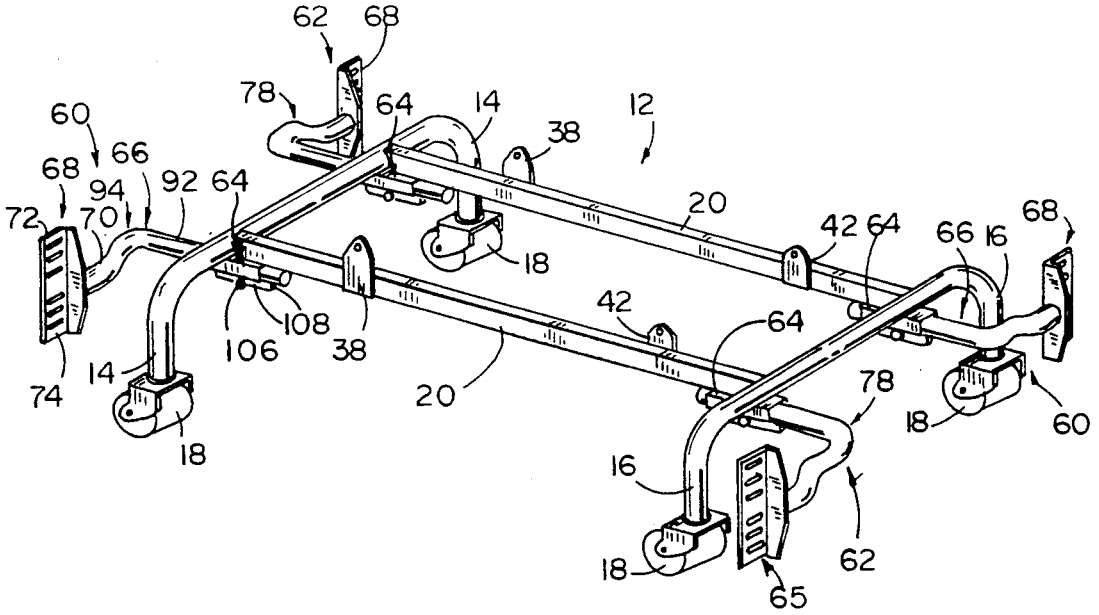
FIG. 2 is a perspective view of a base frame incorporated the bed of FIG. 1 including headboard and footboard mounting assemblies in accordance with the present invention.

In the embodiment illustrated in FIG. 2, mounting assemblies 60, 62 are provided at the head end adjacent legs 14 and at the foot end adjacent legs 16 of frame 12. Tubular support sockets 64 are welded or otherwise suitably secured to the respective lateral portions 20

Figure 3:
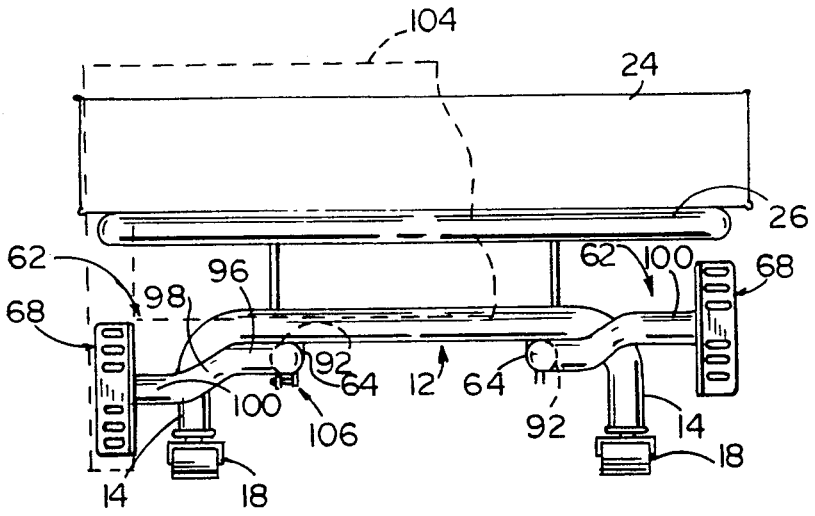
FIG. 3 is an end, elevational view of a bed showing alternative positioning of the headboard or footboard mounting plates.

As best seen in FIG. 3, positioning of the support members 66, 78 within a socket 64 may be such that horizontal portion 100 is offset above a centerline of elongated portion 92 or below the centerline of elongated portion 92. Headboard/footboard mounting slots 72, 74 may be placed in lowered position near the floor permitting mounting of a headboard or footboard 104 at the floor level. When positioned as shown in the right side of FIG. 3, slots 72, 74 are raised so that headboard 104 could be mounted in a floating or raised position off of the floor surface. In addition, tubular support members 66, 78 may be angularly positioned within sockets 64.

Elongated portions 92 are retained within the tubular sockets 64 and clamped therein by a suitable fastener assembly 106. Each tubular socket 64 defines an elongated slot between flanges 108. Fastener 106 pulls flanges 108 towards each other to clamp tubular portion 92 in a locked position. Portion 92 may be rotated and slid axially within the sockets.

The mounting assembly in accordance with the present invention readily accommodates conventional and available headboards and footboards. The user is provided with multiple mounting options. The boards may be positioned at floor level or raised for ease of movement of the bed. Angular positioning of the mounting brackets accommodates variations in the mounting hole locations. Brackets or tubular supports 66, 78 may be positioned axially and/or slid axially within the respective support tubes 64. This permits the user to position the brackets and, hence, the board away from the mattress frame to accommodate angular movement or articulation of the frame. The boards may be positioned outwardly a sufficient distance to avoid pinch points. Custom designed headboards or footboards need no longer be used with an adjustable bed.

Figure 4:
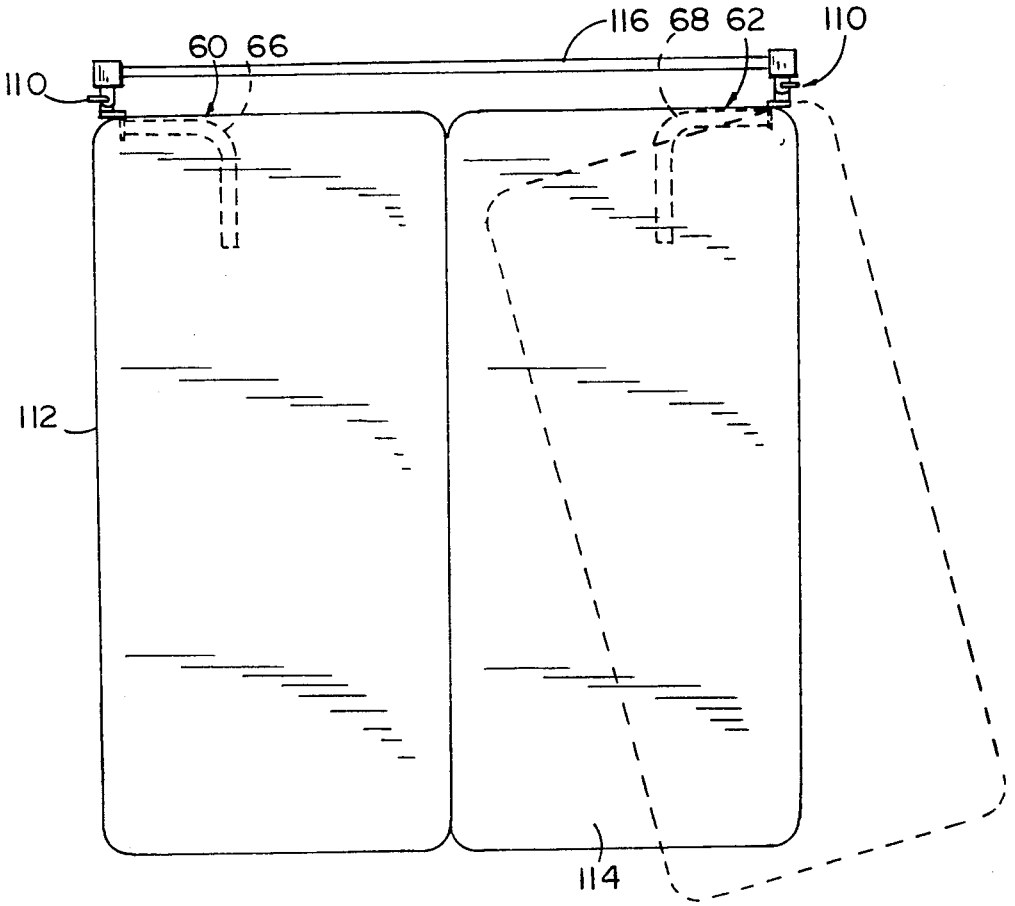
FIG. 4 is a top, plan view showing a pair of beds joined to a common, headboard.
Figure 5:
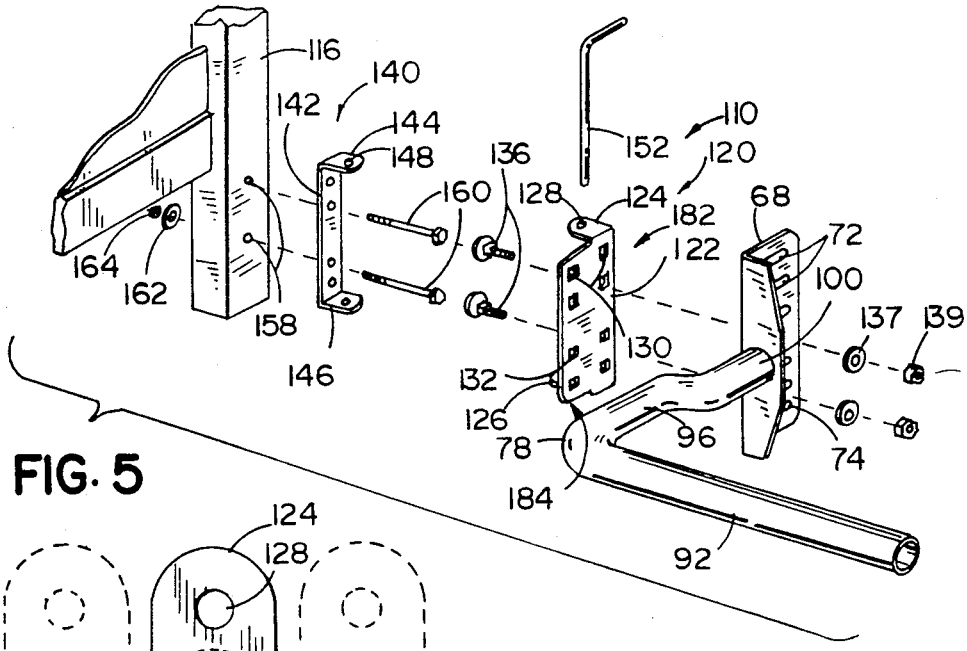
FIG. 5 is an exploded view of a swing kit subassembly in accordance with the present invention.
Figure 6:
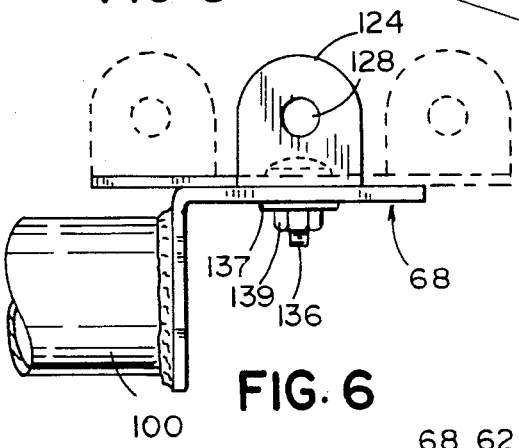
FIG. 6 is a fragmentary, top, plan view of a portion of the mounting assembly and swing plate or bracket in accordance with, the present invention.

As seen in FIGS. 4, 5 and 6, the mounting assembly may include a swing-apart dual king bracket or hinge subassembly generally designated 110. Subassembly 110 mounts on a respective assembly 60, 62 so that a pair of beds 112, 114 may be pivotally connected in a swing-apart fashion to a common headboard 116.

Subassembly 110 includes a first hinge plate or swing bracket 120. Bracket 120 is generally U-shaped and includes a base 122 and hinge tabs 124, 126. Tabs 124, 126 define axially aligned apertures 128. Base portion 122, in accordance with the present invention, includes a plurality of columns of mounting holes 130, 132 arranged in vertically spaced rows. Bracket 120, as seen in FIGS. 5 and 6, is secured to a mounting plate 68 by fasteners 136 which extend through selected ones of holes 130 and slots 72, 74.

A second, generally U-shaped hinge plate or bracket 140 includes a base 142 and hinge tabs 144, 146. Tabs 144, 146 define axially aligned apertures 148. Bracket 140 and bracket 120 are dimensioned so that apertures 144 and 128 may be placed in alignment. A hinge pin 152, passing through apertures 128, 144, pivotally or hingedly interconnects brackets 120 and 140. Bracket 140 is secured to mounting holes 158 in headboard 116 by suitable fasteners 160, washers 162 and nuts 164. Washers 137 and nuts 139 secure fasteners 136 to mounting plate 68.

As seen in FIG. 6, the multiple columns of mounting apertures 130, 132 and bracket 120 permit mounting of the bracket to accommodate different widths of mattresses and headboards. A first column 182 of holes 130, 132 extends vertically along base 122 on an axis which is spaced from and parallel to the axis of apertures 128. Column 182 permits bracket 120 to be mounted on center with apertures 128. The second column 184 of holes 130, 132 is offset transversely from column 182. As shown in phantom, column 184 permits mounting of bracket 120 off center or outwardly from plate 68. By rotating bracket 120 through one hundred and eighty degrees, hinge apertures 128 may be positioned inwardly relative to mounting plate 68. Bracket 120, therefore, provides alternative mounting options which accommodate width variations in headboard mounting holes and, which in conjunction with or separate from slots 72, 74, permit overall bed width adjustment. Bed width adjustment may be necessary to accommodate variations in actual mattress widths.

As shown in FIG. 4, a pair of swing kits 110 in cooperation with mounting assemblies 60, 62 position beds 112, 114 on a common headboard 116. As shown in phantom, the beds may be swung apart to ease linen changes, for cleaning and the like. Variations in headboard dimensions, bed width, mattress width and the like are readily accommodated. The mounting assembly and swing-apart kit subassembly bring the benefits of and permit the use of conventional headboards and footboards to adjustable beds.

Figure 7:
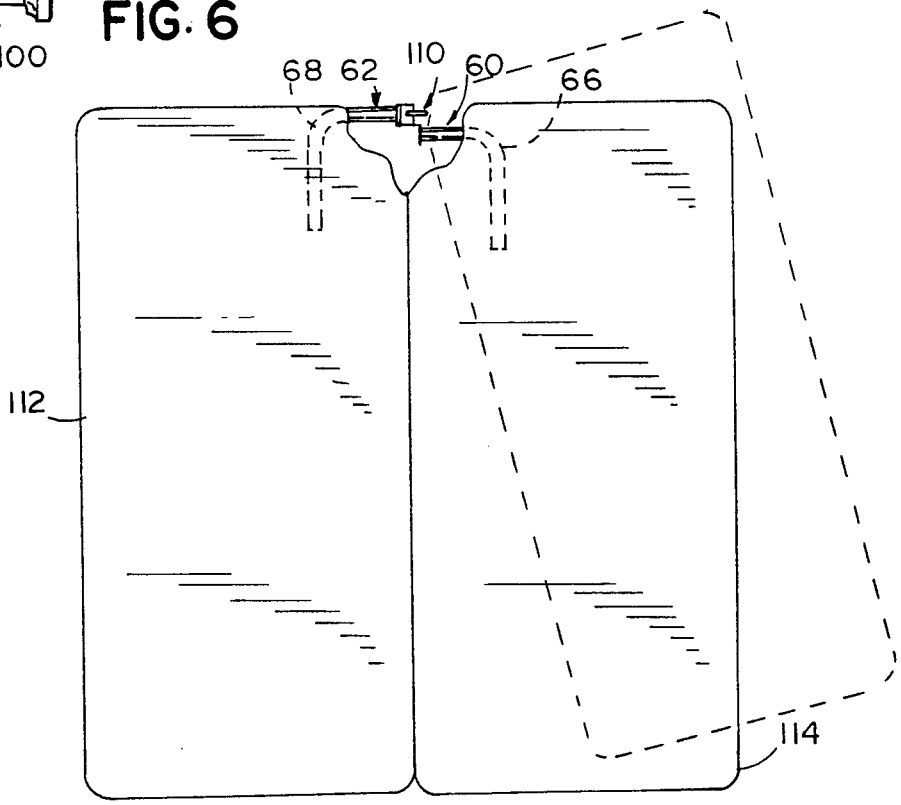
FIG. 7 is a top, plan view of an alternative arrangement interconnecting two beds in a swing-apart dual king fashion.
Figure 8:
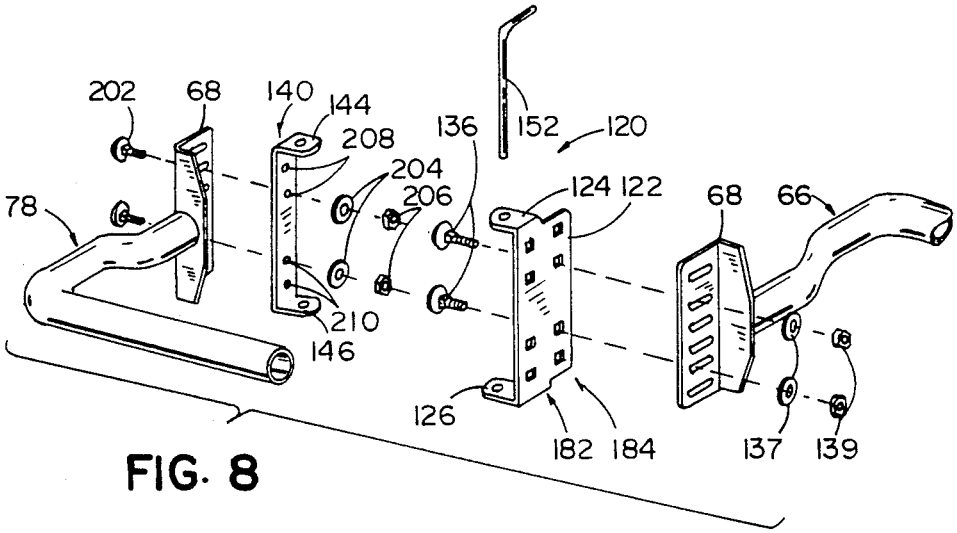
FIG. 8 is an exploded, fragmentary view of the mounting assembly and swing kit assembled in accordance with the arrangement of FIG. 7.

As shown in FIGS. 7 and 8, mounting assemblies 60, 62 in conjunction with a swing-apart dual king bracket subassembly 110 permit the swing-apart connection of two beds 112, 114 without the use of a headboard. Bracket 120 is joined to mounting plate 68 of mounting assembly 60 supported on bed 114. Bracket 140 is secured to mounting plate 68 by suitable fasteners 202, washers 204 and nuts 206 passing through mounting holes 208, 210 and slots 72, 74. Mounting assembly 62 on bed 112 is, therefore, hingedly joined to mounting assembly 60 on bed 114. The separate beds may pivot about pivot pin 152. The hardware in accordance with the present invention allows the mounting of conventional headboards and footboards in lowered or raised positions, accommodates variations in mounting hole location and combines two twin beds to form a swing-apart dual king assembly. The dual king assembly may be formed with or without a headboard.

Figure 9:
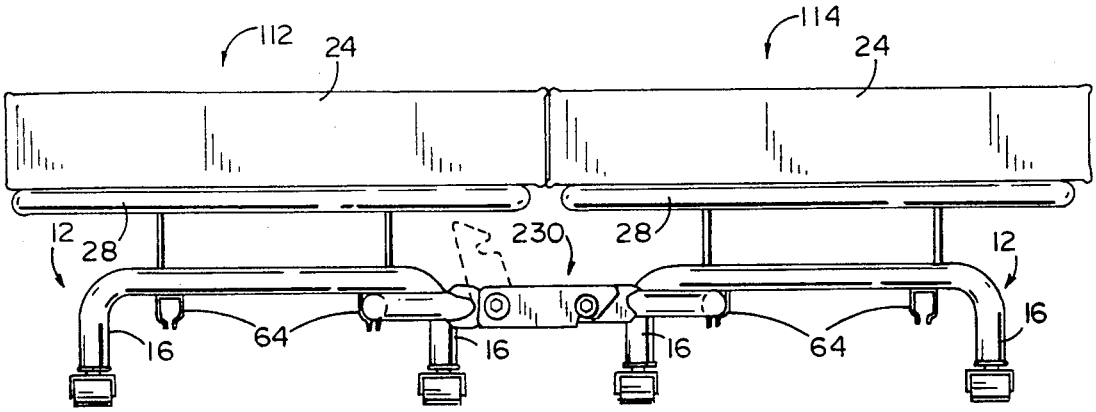
FIG. 9 is an end, elevational view showing a pair of beds and a latch assembly in accordance with the present invention.
Figure 10:
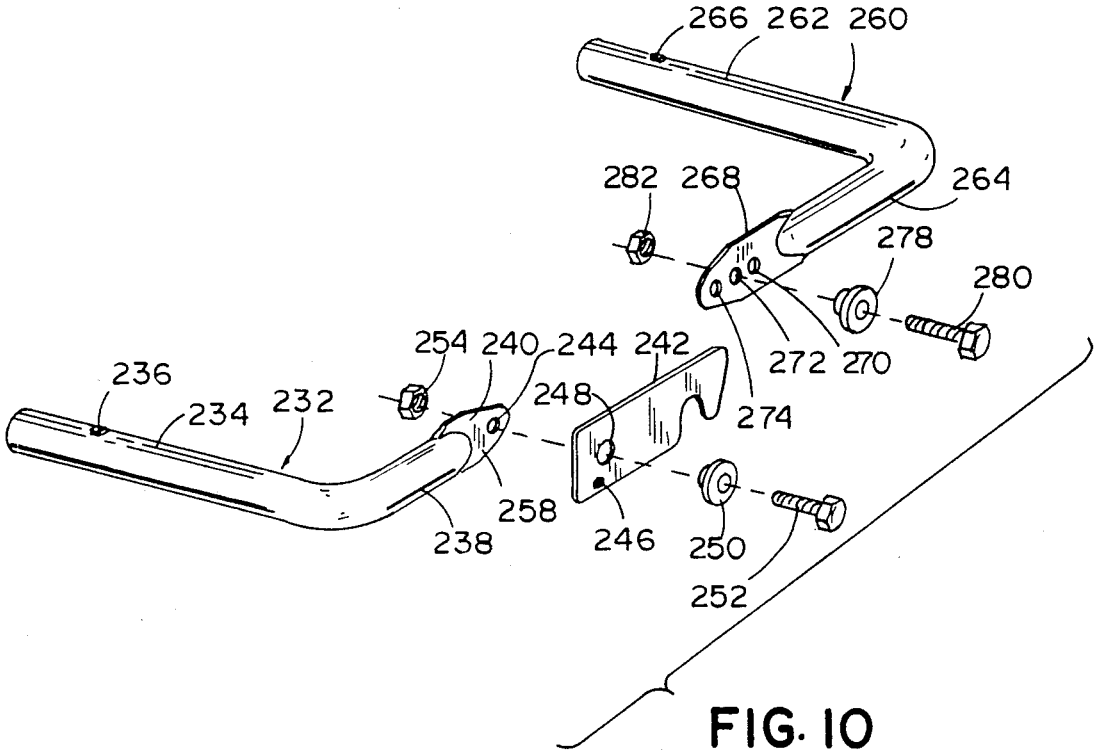
FIG. 10 is an exploded, perspective view of the latch assembly.
Figure 11:
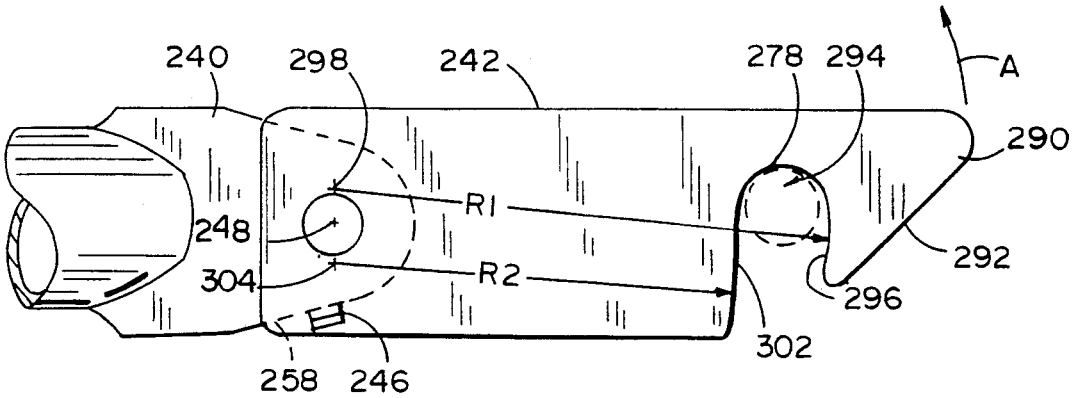
FIG. 11 is an enlarged, elevational view of a latch member incorporated in the latch assembly.

As illustrated in FIGS. 9, 10 and 11, a latch subassembly generally designated 230 may also be included. Latch subassembly 230 secures or locks the foot ends of the beds 112, 114 together when the beds are joined in a swing-apart dual king arrangement. Latch subassembly 230 is supported within tubular sockets 64 secured to adjacent side portions of the respective bed frames 12. Latch 230 includes a first latch bar or tube 232. Tube 232 is generally L-shaped in plan view and includes an elongated portion 234 which extends into socket 64. A stop 236 on portion 234 limits axial movement inwardly within socket 64. Latch tube 232 further includes a second leg or portion 238. Portion 238 is flattened or formed with a latch mounting tab portion 240. A latch 242 is pivotally mounted on tube 232 at a pivot aperture 244. Latch 242 includes a tab 246 and a mounting aperture 248. A bushing 250 is positioned in aperture 248. A fastener 252 threaded to a nut 254 extends through bushing 250 and mounting aperture 244. When mounted on tab 240, tab 246 engages an angled undersurface 258 defined by mounting tab 240. Tab 246 retains latch 242 in a horizontal position as shown in FIGS. 9 and 11.

A catch tube or support member 260 includes a first portion 262 and a second angled portion 264. Catch tube 260 is generally L-shaped in plan. A stop 266 is positioned on portion 262. Portion 262 extends within socket 64, as shown in FIG. 9, until stop 266 engages an outer end of the socket. Portion 264 terminates in a flattened end 268. End 268 is formed with a plurality of catch mounting holes 270, 272 and 274. A catch shoulder washer 278 is secured at a respective one of the holes 270, 272 and 274 by a fastener 280 and nut 282.

Catch shoulder washer 278 is normally positioned in the central hole 272. Normal spacing between the beds is accommodated in this position. Should the mattresses be narrower than standard, hole 270 can be used, which draws the foot ends of the beds together. If the mattress is slightly wider than normal, the outward hole 274 can be used, which positions the foot ends of the beds further apart. In the alternative, an elongated adjustment slot could be substituted for the individual holes.

FIG. 11 is an enlarged view showing details of the latch 242. As discussed above, latch 242 is maintained in the normal horizontal position by tab 246, which engages tangentially angled surface 258. A forward end 290 of latch 242 defines an angled camming surface 292. As beds 112, 114 are moved together, camming surface 292 engages catch 278 and automatically cams upwardly or rotates in a counter-clockwise direction, in the direction of arrow A, over and onto the catch shoulder washer. Washer 278 normally resides within a downwardly opening slot or semicircular opening 294. Opening 294 includes an outer vertical edge 296 which smoothly joins into the camming surface 292. Vertical edge 296 is defined by a radius Rl having a center point 298 positioned above the center line of hole 248. Opening 294 further includes an inboard surface 302 created or defined by a radius R2 having its center point 304 located below the centerline of hole 248 or the pivot point of latch 242. An external force tending to pull the beds apart causes surface 296 to engage catch shoulder washer 278. This sets up a moment arm about center 298 creating a clockwise rotational force on the latch 242 tending to ensure engagement of the latch with the catch shoulder washer. An external force tending to push the beds together causes catch shoulder washer 278 to engage surface 302. The external force again creates a clockwise rotational force or a moment arm about center 304 tending to hold the latch closed.

To swing the beds apart, the user rotates latch member 242 vertically. The latch member is moved to a position past vertical, as illustrated in phantom in FIG. 9. The latch is maintained out of the way of the user's legs. The beds may then be swung apart. To relatch the beds, latch member 242 is positioned in its normal horizontal position and the beds are pushed together until camming surface 292 engages the catch shoulder causing latch member 42 to ride up and over the catch shoulder until it is received within opening 294. Tab 246 maintains latch 242 horizontal. The latch may not drop downwardly to a position where it might be in the way of the user's legs.

In view of the above description, those of ordinary skill in the art may envision various modifications which would not depart from the inventive concepts disclosed. The above description should be considered as only that of the preferred embodiments. The true spirit and scope of the present invention may be determined by reference to the appended claims.

The embodiments of the invention in which an exclusive property or privilege is claimed are defined as follows:

1. A mounting assembly for mounting a headboard or footboard to a bed frame, said mounting assembly comprising:

a socket adapted to be secured to a bed frame;

a configured member having an elongated first portion rotatably and adjustably disposed within said socket and a second portion offset from and joined to said first portion and which includes a free end; and a mounting plate joined to said free end of said configured member, said plate defining a plurality of vertically spaced slots, said elongated first portion of said configured member being adjustable axially and angularly within said socket so that a headboard can be attached to said mounting plate and positioned at floor level or at a raised level.

2. A mounting assembly as defined by claim 1 further including hinge means connected to said mounting plate for hingedly connecting said mounting plate to a headboard.

3. A mounting assembly as defined by claim 2 wherein said hinge means comprises:

a first hinge bracket having a base connected to said mounting plate and a pair of vertically spaced hinged tabs defining a first pair of axially aligned hinge apertures;

a second hinge bracket including a base and a pair of vertically spaced hinged tabs which define a second pair of hinge apertures axially aligned with said first pair; and a pivot pin extending through said pairs of hinge apertures.

4. A mounting assembly as defined by claim 3 wherien said base of said first hinge bracket defines a plurality of mounting holes arranged in spaced vertical columns and wherein said assembly further includes a plurality of fasteners extending through said mounting holes and said slots of said mounting plate.

5. A mounting assembly for mounting a headboard or footboard to a bed frame, said mounting assembly comprising:

a socket adapted to be secured to a bed frame;

a configured support member having an elongated first portion disposed within said socket and a second portion joined to said first portion and which includes a free end; and a mounting plate joined to said free end of said configured member, said plate defining a plurality of vertically spaced slots, said elongated first portion of said configured members being adjustable axially and angularly within said socket, and wherein said second portion of said configured member includes a first generally horizontal portion, an angled intermediate portion and a second generally horizontal portion offset from said first generally horizontal portion.

6. A mounting assembly as defined in claim 5 wherein said configured member is generally L-shaped in plan view.

7. A mounting assembly as defined in claim 6 wherien said socket includes means for holding said elongated first portion of said configured member in a fixed position.

8. A mounting assembly as defined by claim 5 further compising:

latch means adapted to be mounted on a pair of adjacent bed frames for releasably latching the bed frames together.

9. A mounting assembly as defined by claim 8 wherein said latch means comprises:

a latch support;

a latch member having an end pivoted to said latch support, said latch member defining a forward camming surface and a slot; and a latch catch disposed within said latch slot.

10. A mounting assembly as defined in claim 9 further including hinge means connected to said mounting plate for hingedly connecting said mounting plate to a headboard, said hinge means comprises:

a first higne bracket having a base connected to said mounting plate and a pair of vertically spaced hinged tabs defining a first pair of axially aligned hinge apertures;

a second hinge bracket including a base and a pair of vertically spaced hinged tabs which define a second pair of hinge apertures axially aligned with said first pair; and a pivot pin extending through said pairs of hinge apertures.

11. A mounting assembly as defined by claim 10 wherein said base of said first hinge bracket defines a plurality of mounting holes arranged in spaced vertical columns and wherein said assembly further includes a plurality of fasteners extending through said mounting holes and said slots of said mounting plate.

12. A mounting assembly for mounting a headboard or footboard to a bed frame, said mounting assembly comprising:

a socket adapted to be secured to a bed frame;

a configured member having an elongated first portion disposed within said socket and a second portion offset from and joined to said first portion and which includes a free end;

a mounting plate joined to said free end of said configured member, said plate defining a plurality of vertically spaced slots, said elongated first portion of said configured member being adjustable axially and angularly within said socket;

a first hinge bracket having a base connected to said mounting plate and a pair of vertically spaced hinged tabs defining a first pair of axially aligned hinge apertures;

a second hinge bracket including a base and a pair of vertically spaced hinged tabs which define a second pair of hinge apertures axially aligned with said first pair; and a pivot pin extending through said pairs of hinge apertures, said base of said first hinge bracket defining a plurality of mounting holes arranged in spaced vertical columns and wherein said assembly further includes a plurality of fasteners extending through said mounting holes and said slots of said mounting plate; and latch means adapted to be mounted on a pair of adjacent bed frames for releasably latching the bed frames together, said latch means comprising:

a latch support;

a latch member having an end pivoted to said latch support, said latch member defining a forward camming surface and a slot; and a latch catch disposed within said latch slot.

13. A swing-apart dual king bracket assembly for pivotally connecting a pair of adjacent bed frames to a headboard or to each other, said assembly comprising:

a first generally U-shaped hinge plate including a base and a pair of spaced hinged tabs which define axially aligned hinge apertures, said base further defining a plurality of vertically spaced rows of mounting holes arranged in transversely spaced columns;

a second generally U-shaped hinge plate defining second axially aligned hinge apertures;

a hinge pin extending through said hinge apertures of said first and second hinge plates;

a bed frame mount including a mounting plate defining a plurality of vertically spaced, generally horizontal slots;

a plurality of fasteners extending through mounting holes of said first hinge plate and said slots;

a socket adapted to be secured to a bed frame; and a configured support member having a first portion disposed within said socket and a second, offset portion joined to said mounting plate.

14. A swing-apart dual king bracket assembly for pivotally connecting a pair of adjacent bed frames to a headboard or to each other, said assembly comprising:

a first generally U-shaped hinge plate including a base and a pair of spaced hinged tabs which define axially aligned hinge apertures, said base further defining a plurality of vertically spaced rows of mounting holes arranged in transversely spaced columns;

a second generally U-shaped hinge plate defining second axially aligned hinge apertures;

a hinge pin extending through said hinge apertures of said first and second hinge plates;

a bed frame mount including a mounting plate defining a plurality of vertically spaced, generally horizontal slots; and a plurality of fasteners extending through mounting holes of said first hinge plate and said slots, and wherein said bed frame mount further includes:

a socket adapted to be secured to a bed frame; and a configured support member having a first portion disposed within said socket and a second, offset portion joined to said mounting plate, said configured support member being generally L-shaped in plan view.

15. A bracket assembly as defined in claim 14 wherein said second portion of said support member includes vertically offset sections.

16. A bracket assembly as defined in claim 15 wherein said socket includes clamping means for clamping said elongated first portion of said configured member in a fixed position.

* * * * *